United States Patent [19]

Bond, III

[11] 4,295,614

[45] Oct. 20, 1981

[54] PNEUMATICALLY OPERATED GRAIN HANDLING APPARATUS

[76] Inventor: Ned J. Bond, III, P.O. Box 40246, Houston, Tex. 77040

[21] Appl. No.: 84,831

[22] Filed: Oct. 15, 1979

[51] Int. Cl.[3] ..... B02C 25/00

[52] U.S. Cl. ..... 241/34; 241/37; 241/231

[58] Field of Search ..... 241/30, 34, 37, 231; 99/488; 73/861.39

[56] References Cited

U.S. PATENT DOCUMENTS 811,574 2/1906 Nikolai ..... 241/37

3,468,488 9/1969 Karrer et al. ..... 241/37 X

FOREIGN PATENT DOCUMENTS 698085 10/1953 United Kingdom ..... 241/37

*Primary Examiner*—Mark Rosenbaum

*Attorney, Agent, or Firm*—Gunn, Lee & Jackson

[57] ABSTRACT

For use in a grain feed system at a grain processing plant, the preferred and illustrated embodiment discloses a pneumatically powered control system connected to a gate in the grain processing apparatus to open the gate and further discloses a pneumatically operated grain processing apparatus. The control system responds to the presence of grain. As the grain flows through the processing equipment, the gate and processing apparatus are maintained in an operative state. On sensing the absence of grain, the sensor triggers signals which close the hopper supply system for grain and disables the grain processing equipment.

9 Claims, 1 Drawing Figure

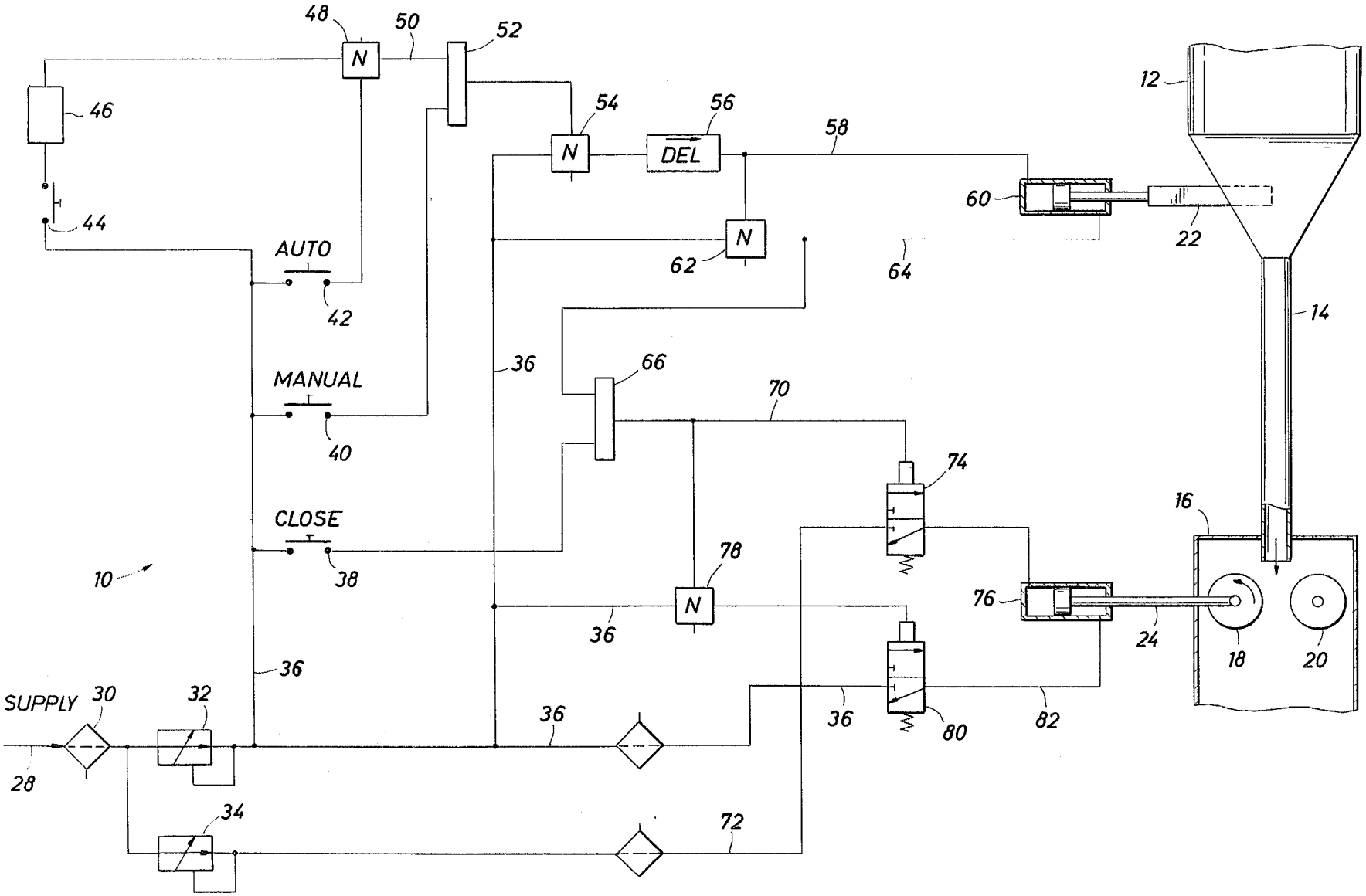
AUTO
MANUAL
CLOSE
SUPPLY
DEL
N
N
N
N
N
12
14
16
18
20
22
24
28
30
32
34
36
38
40
42
44
46
48
50
52
54
56
58
60
62
64
66
70
72
74
76
78
80
82
10

PNEUMATICALLY OPERATED GRAIN HANDLING APPARATUS

BACKGROUND OF THE DISCLOSURE

The present disclosure is directed to a control apparatus for grain handling equipment. Grain handling inevitably involves the creation of dust and the risk of dust explosions. Grain dust creates an explosive hazard at any location where sufficient quantities of grain are handled. There are various explosion suppression techniques suitable for grain handling equipment. The present apparatus is particularly beneficial in suppressing the tendency to explode in granaries inasmuch as this apparatus avoids the use of electricity in the near vicinity of the granary. Grain dust is particularly a hazard in areas where the grain is processed in comparision with storage of grain. Clouds of dust are created by the handling which makes handling somewhat hazardous.

The present apparatus is a control system and control apparatus for installation in a grain processing facility. The apparatus has as one advantage the utilization of a pneumatic control system which reduces the hazard of explosion because electrical power is not required. Rather, the control system utilizes pneumatic power to operate two pieces of equipment. It incorporates a sensor which responds to the presence or absence of grain. The system is maintained on as long as grain is present. The apparatus, however, senses when the grain is no longer present and switches the grain processing equipment off. This is cooperative with grain processing equipment having a gate in a hopper to control the feed of grain to be processed. The processing equipment, itself, is operated by means of a control rod which can be connected to switch equipment off and on within the processing equipment. The two components in the grain processing equipment are thus implemented by motion which is under control of the control system in cooperation with the sensor. One important feature of this disclosed apparatus is incorporation of a sensor at a suitable location in the grain feed apparatus to respond to the presence of grain feed. In particular, the apparatus utilizes a pneumatically powered sensor to detect the presence or absence of grain. One or more sensors can be mounted and arranged in series or parallel as the requirements dictate to thereby enable the control apparatus to respond to grain flow. The response from the sensor thus dictates operation of the control system.

BRIEF SUMMARY OF THE DISCLOSURE

This apparatus is a control system for use with grain handling apparatus. It cooperates with a grain handling system involving a first powered control in a hopper typically connected to a gate whereby flow of grain through the hopper is controlled. It operates a second control apparatus in the grain processing equipment, both being powered by pneumatic power applied to a double-acting cylinder and piston arrangement. The first opens or closes a gate. The second turns off or on equipment within the grain processing apparatus such as rubber rollers for shelling the grain.

The control apparatus utilizes one or more sensors installed to detect the presence or absense of grain and further responds with an automatic control system to manipulate the pair of pneumatically powered grain processing components.

BRIEF DESCRIPTION OF THE DRAWINGS

So that the manner in which the above recited features, advantages and objects of the invention, as well as others which will become apparent, are attained and can be understood in detail, a more particular description of the invention briefly summarized above may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

The single drawing is a pneumatic schematic of the control apparatus of the present invention installed on a grain handling system.

DETAILED DESCRIPTION OF THE ILLUSTRATED EMBODIMENT

Attention is first directed to the only drawing, where the control apparatus of the present invention is identified generally by the numeral 10. The control apparatus is understood by describing a portion of the grain processing equipment. To this end, the grain processing equipment includes a hopper 12 which is adapted to receive a flow of grain. The hopper 12 has a funnel in the lower portions which connects into a conduit 14 which delivers grain at a regulated rate of flow to a grain sheller 16. The sheller 16 utilizes rubber rollers 18 and 20 to process the grain, namely, by breaking or cracking the husk on the grain. The equipment shown in the drawings is particularly useful for shelling rice, thereby removing the outer husk and leaving the kernel which is subsequently processed for human consumption. The grain processing equipment, primarily the sheller 16, will generate a tremendous amount of heat if the rubber rollers 18 and 20 are allowed to rub together in the absence of grain flow and, therefore, must be shut down if there is not a continual inflow of grain to be shelled. The present invention provides a control system which regulates the inflow and which shuts down the equipment in the event the flow of grain is interrupted.

The hopper 12 accumulates grain and serves as a buffer to modulate the rate of flow to an even flow. To this end, a sliding gate 22 is positioned to block the passage 14. The gate 22 is either open or closed. It is open when grain is readily available. Grain will pile up in the hopper 12, but the rate of flow through the passage 14 is fairly well regulated by the dimensions of the equipment. The gate 22 is closed when no grain is present. This prevents grain from inadvertently passing from the hopper through the processing equipment when it is turned off. The gate 22 thus slides laterally to block the hopper.

The grain sheller 16 incorporates rollers 18 and 20. They are positioned adjacent to one another. They are also driven. When grain is present, it falls between the rollers, and the friction between the rubber rollers and the grain removes the husks. When grain is absent, it is desirable to move the rollers apart, and, to this end, the roller 18 is mounted on a shaft which, in turn, is supported on a piston rod 24. The piston rod 24 is retracted to withdraw the roller to a remote location relative to the roller 20. Either roller could move, but it is expedient to move only one.

The numeral 28 identifies an air supply line provided from a very remote location incorporating an air compressor operating at a suitable regulated pressure. It will be presumed that the air flow has been filtered and regulated to the requisite levels. Filters and regulators are ignored in the control system to be described, but they should be added as needed. Ordinarily, the air supply should be dry, although lubricators are ideally located in the system and provide lubricant in the air flow delivered to the double-acting cylinders which will be mentioned.

The supply line 28 connects to a filter 30. In turn, it delivers air through a regulator 32 for the control system. A branch connects through a regulator 34 which, in turn, delivers air for operation of one of the double-acting cylinders. The numeral 36 identifies the supply line, and this line is input to several switches. The first switch is a "close" switch 38. The numeral 40 identifies a manual override switch which operates the equipment in the manual mode. If the switch 40 is actuated, it overrides the status in the grain handling equipment determined by the sensors. The numeral 42 identifies an automatic mode switch. The switch 44 is a second automatic mode switch. Both must be depressed to initiate operation in the automatic mode. The description hereinafter will presume that the equipment is operating in the automatic mode, and no mention will be made of operations resulting from closure of the switches 38 and 40 until after a full, detailed description of the automatic mode is set forth.

When the switch 44 is closed, it enables a set of sensors. A first sensor 46 is an interrupted flow device. If the grain is present in the hopper at the location where the sensor 46 is installed, the grain interrupts the flow of air. If there is no grain, flow is not interrupted. In other words, the sensor responds to the absence of grain and forms a continuous flow of air through it. This flow of air is thus transferred from the sensor 46 to a NOT gate 48. The NOT gate is provided with supply pressure from the line 36 through the automatic switch 42, enabling the gate 48 for operation. An interrupt in flow of air from the sensor 46 is provided to it. This is a drop in pressure and will be termed hereinafter as a zero level signal, a false signal, a logical zero or the like. As will be appreciated, binary terms such as this describe the operative state of the signals in the pneumatic system, and they typically have two values. When the sensor 46 senses grain and interrupts flow, it provides a zero logical level to the NOT gate 48, and that, in turn, forms a positive going or logical one signal on the output conductor 50.

An OR gate 52 is provided with the signal from the line 50 and also from the manual switch 40. If either provides a logical one, then the output of the OR gate 52 is also a logical one. The OR gate 52 is thus provided with a logical one input signal from either the switch 40 or the sensor input on the line 50. The OR gate 52 forms a logical one output signal on sensing grain or being placed in the manual operating mode. The logical one output signal is supplied to a NOT gate 54 which forms a logical zero output signal from the gate 54 which is then input to a delay element 56. It forms a logical zero output signal after a delay interval. That, in turn, is supplied over a line 58 to one end of a double-acting cylinder 60. The cylinder 60 encloses a piston which is, in turn, connected to a piston rod connected to the gate 22. The line 58 thus drops to a logical zero which is a low pressure level. The levels are relative and, for example, can operate with pressures in the range of perhaps 50.0 to 125.0 psig. Thus, the line 58 drops to a logical zero or a low value as, for instance, in venting to atmosphere. In any event, the logical zero input to the delay element 56, in turn, creates a logical zero in the line 58.

The delay line is included so that momentary interruptions in grain flow at the sensor do not quickly trigger movement of the gate 22. The delay can be perhaps 1.0 to 5.0 seconds as an example. If the sensor maintains a signal for more than 5.0 seconds, then the delay element 56 will time out and move the gate 22.

A NOT gate 62 is provided with the output signal from the delay element 56. When a logical zero is output from the delay element 56, a logical one is output by the NOT gate 62. Its output line 64 is input to the opposite end of the cylinder 60 which is a double-acting structure.

From the foregoing, it will be observed that the cylinder 60 is driven in both directions. When grain is present, the gate 22 is opened, and the gate 22 is closed when grain is not present. In the example given for operation which assumes that the sensor 46 detects grain, the circuit further utilizes an OR gate 66. The OR gate 66 is thus provided with a logical one and, in turn, forms a logical one output when grain is sensed. In the alternative, it is connected to the switch 38. The switch 38 is thus an alternate input to the OR gate 66. If either input is provided with a logical one, the OR gate 66 forms a logical one output.

The output from the OR gate 66 is on a conductor 70. The conductor 70 is input to a pilot operated, return spring, three-way valve 74. The valve is shown in its normal position. The valve is operated by a logical zero furnished on the line 70. It then moves to the alternate position.

It will be observed that a supply line 72 is input to the valve 74. The valve 74 is thus operated by the logical one on the conductor 70 and forms a logical one output signal. The line 72 is thus connected through the valve 74 to a double-acting cylinder 76. The cylinder 76 is provided with pressure inlets at both ends, thereby driving the piston in both directions to reciprocate the piston rod 24 which, in turn, moves the roller. The piston rod 24 is thus positively positioned at one end or the other of the cylinder.

The line 70 is connected to a NOT gate 78. When a logical one is formed by the OR gate 66, the NOT gate 78 forms a logical zero supplied to the pilot operator of a spring return, pilot driven, three-way valve 80. The supply line 36 is input to it and furnishes a logical one. The valve 80 is, in the presence of a logical zero from the gate 78, operated to the illustrated position wherein the line 82 from the cylinder 76 is dumped to atmosphere. The illustrated position in the normal position. When a logical one is provided from the gate 78, the supply line 36 delivers the logical one through the valve 80 and the line 82. However, in the illustrated condition, the line 82 is dumped to atmosphere to enable the piston 76 to travel the full length of the cylinder.

One cycle of operation will be described. Assuming that a suitable supply pressure is furnished on the line 28, if the switch 38 is operated, a closure instruction is provided. This has the form of a logical one input to the OR gate 66. A logical one at that gate is coupled to the line 70 and valve 74. This furnishes supply from the line 72 to the cylinder 76 to extend the piston rod 24, hereinafter described as the operate position. This position is coupled to the grain processing equipment in the sheller 16. This position is maintained as long as the switch 38 is closed.

If the switch 40 is operated, it forms a logical one at the input of the OR gate 52. That, in turn, forms a logical one input to the gate 54. This forms a logical zero at the output of the gate 54 and at the output of the delay element 56 after a requisite interval. This inputs a logical zero or an air reduction to the left-hand side of the cylinder 60. In conjunction with this, the NOT gate 62 couples a logical one on the line 64 which has the form of elevated pressure and thereby forces the piston to the left in the cylinder 60. This opens the gate 62. It will be recalled this occurs under manual control.

If the switches 42 and 44 are operated, they enable a sensor to thereafter function. When the sensor functions, it functions by interrupting air flow on detecting the presence of grain. This signal is coupled from the sensor in the form of a logical zero. The logical zero is inverted by the NOT gate 48 to form a logical one on the line 50 and operates the OR gate 52 in the same fashion as occurred under control by the manual switch. This, again, opens the gate 22 under control of the cylinder 60. Simultaneous with this, signals are coupled from the NOT gate 48, OR gate 52, NOT gate 54, delay element 56, NOT gate 62, OR gate 66 and the line 70 to the control valve 74 for extending the piston rod 24. This is a mechanical indicia to the rice sheller apparatus that it is timely to operate. As long as grain is sensed, this signal persists. When grain is not present, the sequence of signals coupled from the sensor 46 closes the gate 22 and withdraws the piston rod 24.

Ideally, a clean air supply is used which is free of dust and lint. Suitable filters and pressure regulators are included in the system. Depending on the type of valves 74 and 80 which are used in the system, it may be helpful to install lubricators upstream of them which are devices to inject a small amount of lubricant in the air flow.

It has been assumed that the cylinders 60 and 76 are of small to intermediate size. If larger sizes are required to impart significantly larger forces, it may be necessary to install an amplifier system. In this event, a high pressure line of significant volume capacity is connected to the cylinders by means of two-position, four-port, double-pilot operated valves. Thus, the lines 58 and 64 will then connect to the pilots to operate the large valve. In like fashion, the same substitution would be made for the supply for the cylinder 76.

While the foregoing is directed to the preferred embodiment, the scope of this apparatus is determined by the claims which follow.

I claim:

1. An apparatus for controlling the delivery of grain which comprises:

(a) a grain hopper having a restricted grain flow outlet;

(b) movable gate means operatively positioned relative to said grain hopper for selectively controlling the flow of grain from the grain flow outlet thereof, said gate having open and closed positions;

(c) grain processing equipment connected to receive grain from said grain flow outlet and which is operated by axial movement of a piston rod where extension thereof operates the equipment and retraction thereof modifies the operation of the grain processing equipment;

(d) grain flow sensor means adapted to be installed in a path of flow for the grain through said hopper and which sensor means forms a pneumatic binary output indicative of the presence or absence of grain flow and further wherein said sensor means is installed in the flow path of grain flowing through said hopper; and (e) pneumatically powered control means connected to said sensor means and responsive to the signal provided thereby to form a control signal for operation of said gate means, said gate means being opened in the presence of grain flow and being closed in the absence of grain flow by said control means.

2. The apparatus of claim 1 wherein said control means further operates said grain processing equipment by extending or retracting said piston rod so that said grain processing equipment is operated when said gate means is open and is not operated when said gate means is closed.

3. The apparatus of claim 2 wherein said sensor means is provided with air from an air source and wherein said air source powers said control means and said control means connects to a double-acting, pneumatically operated piston and cylinder for each of said gate means and said piston rod.

4. The apparatus of claim 3 including a pneumatic logic circuit element which requires an input signal extending over a timed duration in said control means and wherein said element is connected in a manner such that said sensor means must detect the absence of grain for a selected interval determined by said element and said element times out only after passage of the timed duration.

5. The apparatus of claims 3 or 4 including control valve means connected to each of said pistons and cylinders.

6. The apparatus of claim 3 including an override switch which forms a signal corresponding to the presence of grain detected by said sensor means.

7. The apparatus of claim 3 including an enable switch means serially connected with said sensor means to enable operation thereof.

8. The apparatus of claim 7 including an override switch which forms a signal corresponding to the presence of grain detected by said sensor means.

9. The apparatus of claim 8 including control valve means connected to each of said pistons and cylinders.

* * * * *